United States Patent [19]

Machado et al.

[11] Patent Number: 4,590,383

[45] Date of Patent: May 20, 1986

[54] SPENT FUEL STORAGE CASK HAVING IMPROVED FINS

[75] Inventors: Octavio J. Machado; Larry E. Efferding, both of Pensacola, Fla.

[73] Assignee: Westinghouse Electric Corp., Pittsburgh, Pa.

[21] Appl. No.: 663,530

[22] Filed: Oct. 22, 1984

[51] Int. Cl.[4] ..... G21F 5/00

[52] U.S. Cl. ..... 250/506.1; 250/518.1; 376/272

[58] Field of Search ..... 250/506.1, 507.1, 518.1; 376/272

[56] References Cited

U.S. PATENT DOCUMENTS 3,113,215 12/1963 Allen ..... 250/506.1

4,339,411 7/1982 Knackstedt et al. ..... 376/272

*Primary Examiner*—Alfred E. Smith

*Assistant Examiner*—Jack I. Berman

*Attorney, Agent, or Firm*—Daniel C. Abeles

[57] ABSTRACT

A cooling fin for a spent nuclear fuel storage cask is fabricated by bending an elongated composite sheet, formed by cladding a stainless steel sheet onto a carbon steel sheet, along its axis to provide two sides joined at a curved apex. The free ends of the sides are welded to the base element of the cask. A pocket is formed between the sides of the fin by welding an end plate to the bottom of the fin, and thereafter resinous neutron absorbing material is poured into the pocket. After the pocket is filled an end plate is welded to the top of the fin.

11 Claims, 7 Drawing Figures

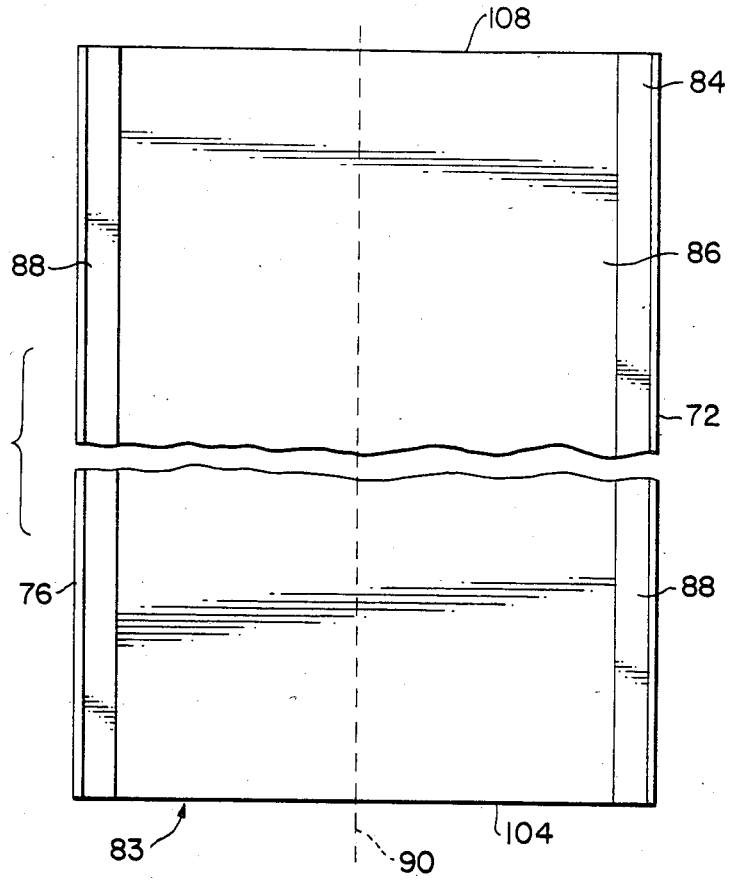
FIG. 6.
FIG. 7.
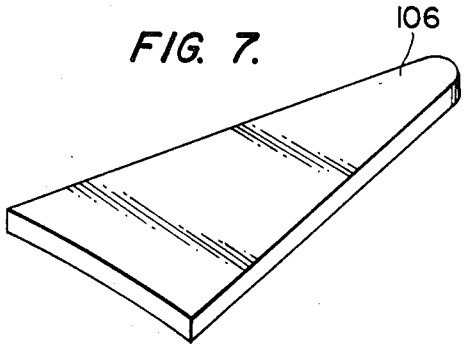

SPENT FUEL STORAGE CASK HAVING IMPROVED FINS

BACKGROUND OF THE INVENTION

The present invention relates to the long-term storage of spent fuel that has been removed from a nuclear reactor, and more particularly, to a spent fuel storage cask having improved fins for dissipating heat generated by the spent fuel.

FIG. 1 illustrates a typical fuel assembly 20 for supplying nuclear fuel to a reactor. Assembly 20 includes a bottom nozzle 22 and a top nozzle 24, between which are disposed elongated fuel rods 26. Each fuel rod 26 includes a cylindrical housing made of a zirconium alloy such as commercially available "Zircalloy-4", and is filled with pellets of fissionable fuel enriched with U-235. Within the assembly of fuel rods 26, tubular guides (not shown) are disposed between nozzles 22 and 24 to accommodate movably mounted control rods (not illustrated) and measuring instruments (not illustrated). The ends of these tubular guides are attached to nozzles 22 and 24 to form a skeletal support for fuel rods 26, which are not permanently attached to nozzles 22 and 24. Grid members 28 have apertures through which fuel rods 26 and the tubular guides extend to bundle these elements together. Commercially available fuel assemblies for pressurized water reactors include between 179 and 264 fuel rods, depending upon the particular design. A typical fuel assembly is about 4.1 meters long, about 19.7 cm wide, and has a mass of about 585 kg., but it will be understood that the precise dimensions vary from one fuel assembly design to another.

After a service life of about three years in a pressurized water reactor, the U-235 enrichment of a fuel assembly 20 is depleted. Furthermore, a variety of fission products, having various half-lives, are present in rods 26. These fission products generate intense radioactivity and heat when assemblies 20 are removed from the reactor, and accordingly the assemblies 20 are moved to a pool containing boron salts dissolved in water (hereinafter "borated water") for short-term storage. Such a pool is designated by reference number 30 in FIG. 2.

Pool 30 is typically 12.2 meters deep. A number of spent fuel racks 32 positioned at the bottom of pool 30 are provided with storage slots 34 to vertically accomodate fuel assemblies 20. A cask pad 36 is located at the bottom of pool 30.

During the period when fuel assemblies 20 are stored in pool 30, the composition of the spent fuel in rods 26 changes. Isotopes with short half-lives decay, and consequently the proportion of fission products having relatively long half-lives increases. Accordingly, the level of radioactivity and heat generated by a fuel assembly 20 decreases relatively rapidly for a period and eventually reaches a state wherein the heat and radioactivity decrease very slowly. Even at this reduced level, however, rods 26 must be reliably isolated from the environment for the indefinite future.

Dry storage casks provide one form of long-term storage for the spent fuel. After the heat generated by each fuel assembly 20 falls to a predetermined level—such as 0.5 to 1.0 kilowatt per assembly, after perhaps 10 years of storage in pool 30—an opened cask is lowered to pad 36. By remote control the spent fuel (either in the form of fuel assemblies 20 or in the form of consolidation canisters which contain fuel rods that have been removed from fuel assemblies in order to increase storage density) is transferred to the cask, which is then sealed and drained of borated water. The cask can then be removed from pool 30 and transported to an above-ground storage area for long-term storage.

FIG. 3 illustrates a sectional view of a typical storage cask 38. Cask 38 includes a cask base element 40 having a floor 42 and a hollow interior provided by cylindrical walls 44. Although not illustrated, the hollow interior houses a fuel support matrix which provides an array of vertically oriented storage slots for receiving spent fuel and which transfers heat generated by the spent fuel to walls 44 for subsequent dissipation into the environment. Cask base element 40 includes a carbon steel portion 46 which is approximately 25 cm thick and which serves to protect the environment from gamma rays. Portion 46 is surrounded by a layer about 7.0 cm thick of neutron absorbing material 48, which may be a resin. Surrounding material 48 is an outer layer 50 of stainless steel to protect cask 38 from the environment. Cask 38 also includes a cask lid element (not illustrated) which is bolted to base element 40 in order to seal the cask after it is loaded with spent fuel. Like base element 40, the cask lid element has a thick carbon steel portion, a neutron absorbing layer, and an outer layer of stainless steel.

With continuing reference to FIG. 3, cask base element 40 includes carbon steel cooling fins 52, which are welded to portion 46 and which extend through material 48 and layer 50. Fins 52 are elongated and have axes that are parallel to the axis of base element 40. Fins 52 are present to conduct heat through material 48, which is not a good heat conductor, and convey it to the environment by means of convection and infrared radiation. Efficient heat removal is essential since the temperature of the fuel rods 26 within cask 38 must be kept below a maximum temperature, such as 375° C., to prevent deterioration of the zirconium alloy housing.

Cask 38 is typically about 4.8 meters high and has an outside diameter of about 2.5 meters, excluding the cooling fins. It has a mass of over a hundred thousand kilograms when loaded with spent fuel. Due to the mass and size of cask 38, it will be apparent that fins 52 are subject to damage as a result of rough treatment or accidents during handling and transportation of the cask.

It is desirable to treat fins 52 in order to protect the carbon steel from chemical attack by the environment. In the past this protection has been supplied by weld-depositing stainless steel ribbons about 2.5 cm wide on the side surfaces 54 of the carbon steel. This is relatively expensive, however, and moreover creates heat distortion and otherwise mars the appearance of the surface of the fins. Furthermore it is difficult to deposit stainless steel to protect the edges 56 of fins 52.

SUMMARY OF THE INVENTION

Accordingly, one object of the present invention is to provide a spent fuel storage cask with improved fins which are easier to protect from the environment than the fins used heretofore.

Another object of the present invention is to provide a mechanically rugged storage cask having improved fins which are less subject to damage than the fins employed heretofore.

Another object of the present invention is to provide a spent fuel storage cask having attractive fins which are not marred by heat distortion resulting from the weld depositing of a protective surface layer.

Another object of the present invention is to provide a spent fuel storage cask with improved fins which radiate heat more efficiently than the fins used heretofore.

In the present invention these and other objects are achieved by providing a cooling fin which is fabricated from an elongated sheet of composite material formed by cladding a stainless steel sheet onto a carbon steel sheet so that the carbon steel and stainless steel are bonded without welding. The composite sheet is then bent along its axis to provide two sides which are joined at a rounded apex. The rounded apex, like the sides, has an outer face which is protected by stainless steel, thereby avoiding an exposed carbon steel edge which must subsequently be protected from the environment. Moreover in cross-section the bent composite sheet resembles two sides of an isosceles triangle, which is completed when the free edges of the sides are welded to the cask base element. The generally triangular geometry of the improved fin imparts a mechanical ruggedness far surpassing that of the prior art fin. Neutron absorbing material is housed in the pocket provided between the sides of the improved fin.

BRIEF DESCRIPTION OF THE DRAWINGS

FIG. 6 is a front elevational view of a composite sheet which is formed by cladding a stainless steel sheet onto a carbon steel sheet and which is used for fabrication of the improved fin of the present invention; and FIG. 7 is a perspective view of an end plate for sealing the top and bottom of the improved fin.

DESCRIPTION OF THE PREFERRED EMBODIMENT

Figure 5:
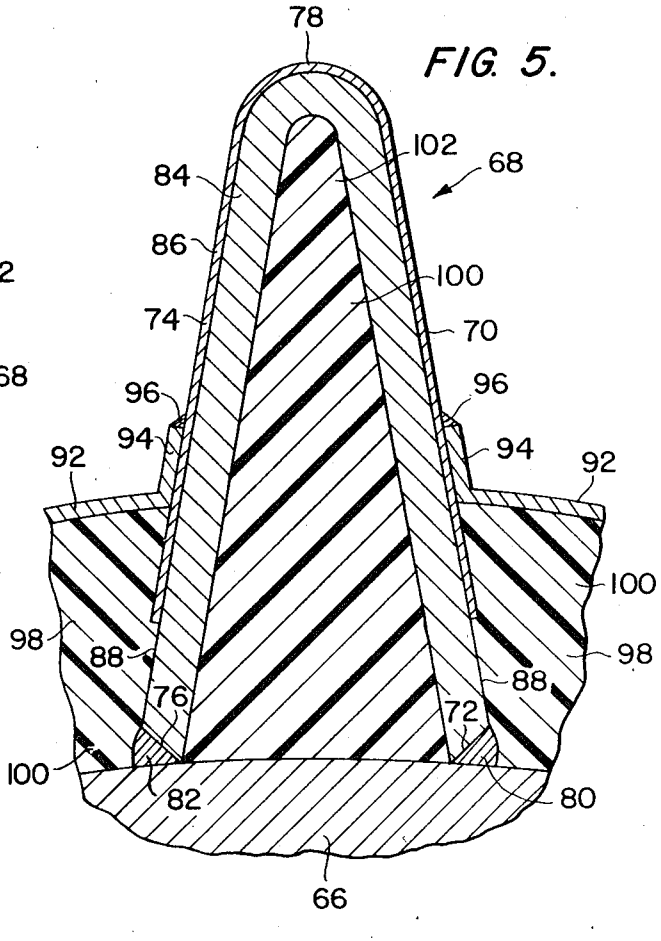
FIG. 5 is a detailed view of region 5 in FIG. 4, and illustrates a cross-sectional view of a single improved fin.
Figure 4:
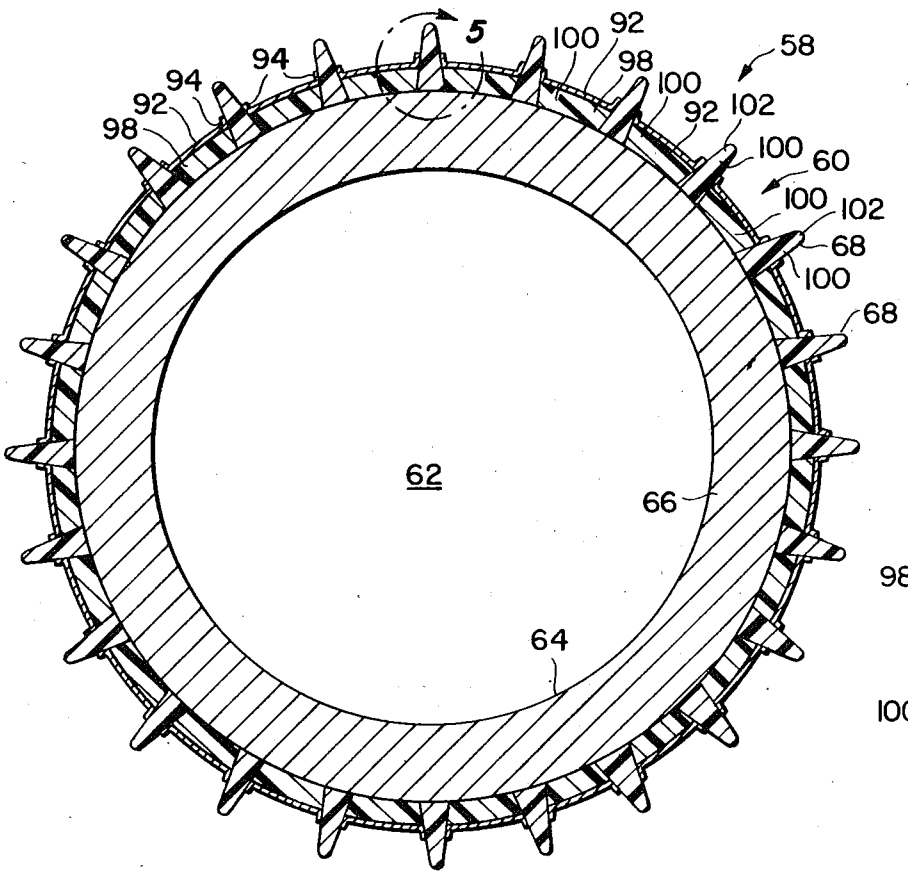
FIG. 4 is a sectional view of the storage cask of the present invention, and illustrates improved cooling fins around the periphery thereof.

With reference first to FIG. 4, cask 58 includes a cask base element 60 having a floor 62 and an internal wall 64 which provide a cylindrical cavity for storage of spent fuel. During storage this cavity is sealed by a cask lid element (not illustrated). Base element 60 includes a cylindrical carbon steel portion 66 having 24 elongated fins 68 welded thereto. As is shown in FIG. 5, each fin 68 has a side 70 terminating in a bevelled edge 72 and a side 74 terminating in a bevelled edge 76. Sides 70 and 74 merge into each other at apex region 78. Full length weld 80 joins side 70 to portion 66 and, similarly, full length weld 82 joins side 74 to element 66. Bevelled edges 72 and 76 are approximately 7.6 cm apart and sides 70 and 74 are approximately 20 cm wide (that is, approximately 20 cm from the associated edge 72 or 76 to region 78). The angle between sides 70 and 74 at apex region 78 is approximately 22°. The length of fin 68 is not critical, but the fin should preferably extend substantially from the bottom of base element 60 to the top.

Turning next to FIG. 6, the fabrication of a fin 68 from a composite sheet 83 will now be described. A sheet of carbon steel 84 is machined to provide bevelled edges 72 and 76. A slightly narrower sheet of stainless steel 86 is affixed to the carbon steel by cladding, leaving unclad borders 88. The cladding operation is well known; for example, some current United States coins include a central metallic layer with outer layers of a different metal clad on either side to form a sandwich of dissimilar metals which are securely joined. Basically, to clad stainless steel 86 to the sheet of carbon steel 84, the adjacent faces of the sheets are thoroughly cleaned and thereafter the sheets are pressed together by rollers as heat is applied. The metals diffuse into each other at their junction and firmly bond the stainless steel to the carbon steel. The resulting composite sheet 83 is then bent at axis 90 to provide sides 70 and 74 joined at apex regions 78.

Returning to FIGS. 4 and 5, stainless steel outer wall segments 92 are provided with flanges 94 which are joined by full length welds 96 to the stainless steel 86 of sides 70 and 74. Segments 92 are closed at the top and bottom by elements (not illustrated), thereby forming pockets 98. Pockets 98 are filled with neutron absorbing material 100. A suitable material 100 is available from Bisco Products, Inc., 1420 Renaissance Drive, Park Ridge, Ill. 60068, under Stock No. NS-3. This material is a resinous substance which is poured into pockets 98 and thereafter cures within the pockets. A similar procedure is used to introduce neutron absorbing material 100 into pockets 102 provided within fins 68. The bottom portion 104 (see FIG. 6) of the fin 68 is closed by welding a stainless steel end plate 106 (see FIG. 7) to fin 68, and thereafter the pocket 102 is completely filled with NS-3. Upon completion of the filling operation, an end plate 106 is welded to top portion 108 of fin 68. The material 100 in pocket 102 not only provides neutron shielding, it also enhances the mechanical strength of the fin 68.

Figure 2:
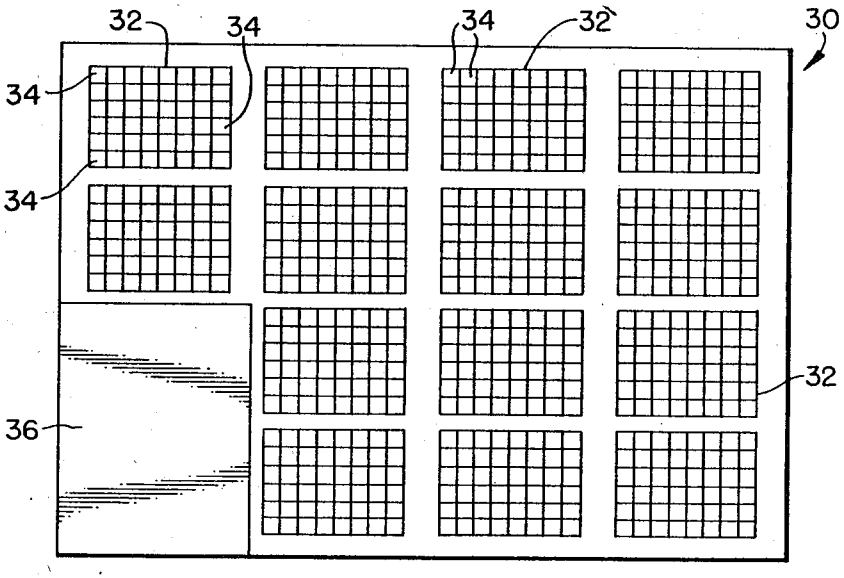
FIG. 2. (PRIOR ART)
FIG. 2 is a top plan view of a pool for short-term storage of spent fuel assembly.
Figure 1:
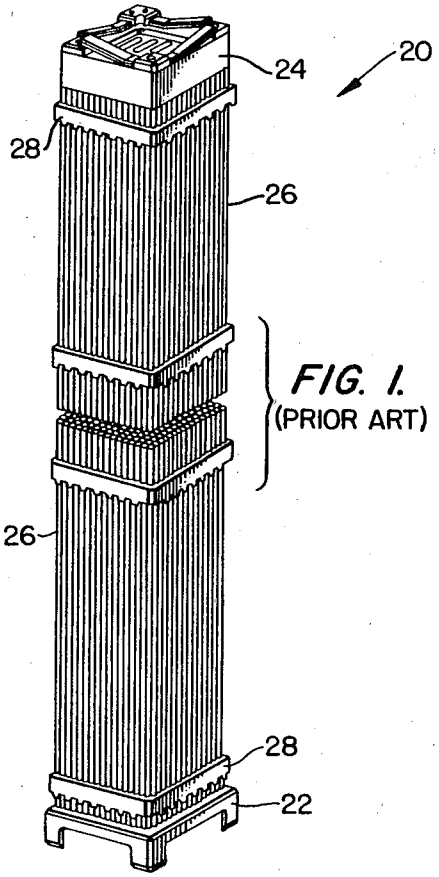
FIG. 1. (PRIOR ART)
FIG. 1 is a perspective view of a typical fuel assembly.
Figure 3:
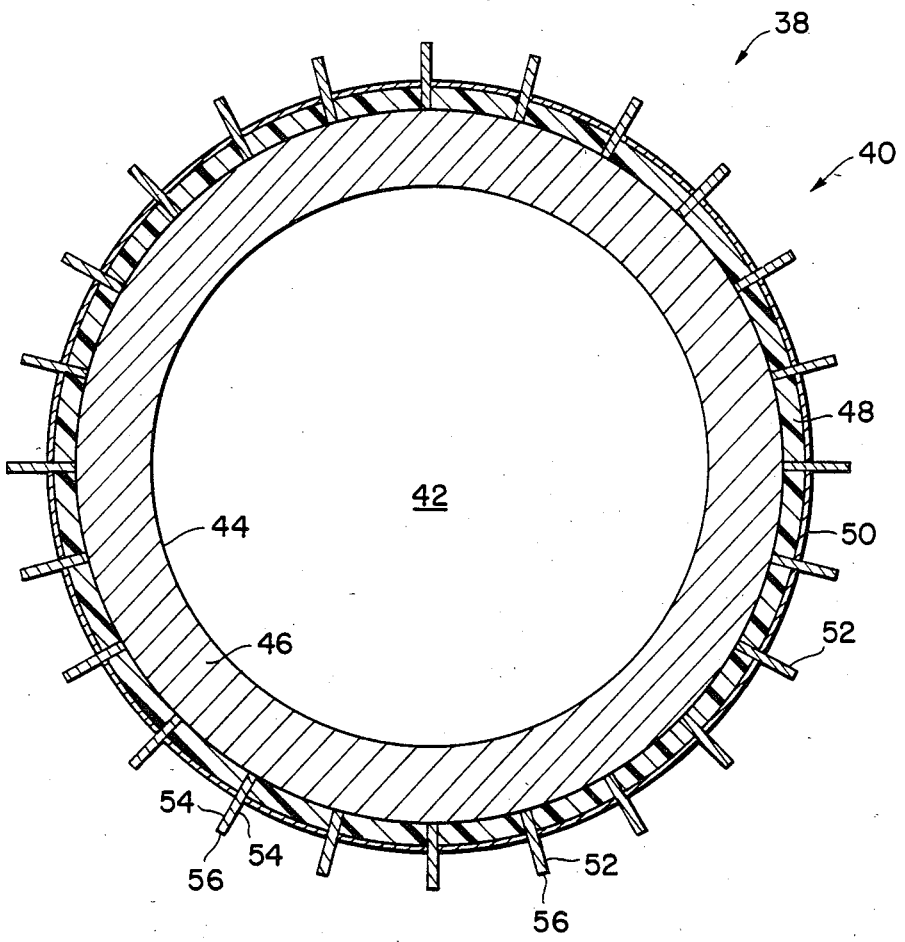
FIG. 3. (PRIOR ART)
FIG. 3 is a sectional view of a prior art spent fuel storage cask.

Comparing FIGS. 3 and 4, it should be noted that the angle between adjacent fins 52 is less than the angle between the side 70 of one fin 68 and the side 74 of the adjacent fin 68. Accordingly, it will be apparent that it is more likely that heat radiated from the side of a fin 52 will impinge upon an adjacent fin 52 than that heat radiated from a side of a fin 68 will impinge upon an adjacent fin 68.

From the foregoing discussion it will be apparent that the present invention provides a spent fuel storage cask having cooling fins with improved mechanical strength, improved heat radiating properties, and improved appearance. Moreover the fins have curved apex regions rather than abrupt outer edges, which are difficult to protect from the environment.

It will be understood that the above description of the present invention is susceptible to various modifications, changes, and adaptations, and the same are intended to be comprehended within the meaning and range of equivalents of the appended claims.

We claim:

1. A cask for storing spent nuclear fuel, comprising:

a cask base element;

a plurality of elongated fins, each fin including a metal element having a pair of sides which are joined at a curved apex region and which have edges spaced apart from the apex region, and a protective metal layer bonded to the metal element at the apex region and at least a portion of each side;

means for affixing the edges of the metal elements to the periphery of said cask base element; and means disposed between the sides of each fin for absorbing neutrons.

2. The cask of claim 1, wherein said protective metal layer is clad to said metal element.

3. The cask of claim 1, wherein said protective metal layer is stainless steel, said metal element is carbon steel, and the stainless steel is clad to the carbon steel.

4. The cask of claim 1, wherein each fin has a top and a bottom, and further comprising, for each fin, an end plate affixed to the bottom of the fin between the sides and an additional end plate affixed to the top of the fin between the sides.

5. The cask of claim 4, wherein said means disposed between the sides of each fin for absorbing neutrons comprises a resinous material which is liquid before being cured while between the sides of the fin.

6. The cask of claim 4, wherein said means disposed between the sides of each fin for absorbing neutrons comprises a resinous material which substantially fills the region between the sides and the end plates.

7. The cask of claim 1, wherein said edges are beveled and wherein said means for affixing the edges of the metal elements to the periphery of said cask base element are welds which join the beveled edges to the cask base element.

8. A method of fabricating a spent nuclear fuel storage cask having a metalic cask base element, comprising the steps of:

forming a substantially flat composite sheet having a top portion, a bottom portion, and substantially parallel edges by bonding a sheet of protective metal onto a sheet of another metal, said composite sheet having an axis running through the top and bottom portions;

bending the composite sheet along said axis to provide a fin having top and bottom portions and having two sides which are joined at an apex region, the surfaces of each side which are formed of said sheet of another metal being adjacent each other;

welding said edges to said base element;

closing the top and bottom portions of the fin;

introducing a liquid neutron absorbing resin into the region between the sides; and curing the resin.

9. The method of claim 8, wherein said protective metal is stainless steel, wherein said another metal is carbon steel, and wherein the step of forming a substantially flat composite sheet comprises cladding a stainless steel sheet having a first width onto a carbon steel sheet having a second width, the second width being greater than the first width.

10. The method of claim 8, further comprising machining said edges to produce beveled edges.

11. The method of claim 8, wherein the step of closing the top and bottom portions of the fin is accomplished by welding a substantially triangular end plate to the bottom portion of the fin and welding another substantially triangular end plate to the top portion of the fin.

* * * * *